US006905039B2

(12) United States Patent
Richter et al.

(10) Patent No.: US 6,905,039 B2
(45) Date of Patent: Jun. 14, 2005

(54) MODULAR UTILITY ASSEMBLY

(75) Inventors: Gary Michael Richter, Waukesha, WI (US); Jeffrey Lee Ranney, Brookfield, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 0 days.

(21) Appl. No.: 10/252,025

(22) Filed: Sep. 20, 2002

(65) Prior Publication Data

US 2003/0076019 A1 Apr. 24, 2003

Related U.S. Application Data

(60) Provisional application No. 60/351,617, filed on Jan. 24, 2002, provisional application No. 60/330,394, filed on Oct. 18, 2001, and provisional application No. 60/324,315, filed on Sep. 24, 2001.

(51) Int. Cl.[7] ..... B65D 21/02
(52) U.S. Cl. ..... 220/23.83
(58) Field of Search ..... 220/908, 23.83, 220/23.86, 475, 480, 481; 248/149, 132, 311.2

(56) References Cited

U.S. PATENT DOCUMENTS

| | | | | |
|---|---|---|---|---|
| D40,166 S | | 7/1909 | McLean | |
| 1,184,674 A | | 5/1916 | Gasser et al. | |
| 1,763,306 A | | 6/1930 | Hendrickson | |
| 2,432,455 A | | 12/1947 | Smith | |
| 2,571,071 A | | 10/1951 | Smith | |
| 2,584,382 A | | 2/1952 | Earle | |
| 2,834,506 A | | 5/1958 | Schaefer, Jr. | |
| 3,594,830 A | * | 7/1971 | Clifton | 4/625 |
| 3,728,003 A | | 4/1973 | Bohannon | |
| 4,130,214 A | | 12/1978 | Sobson | |
| 4,143,792 A | * | 3/1979 | Rex | 221/97 |
| D272,263 S | | 1/1984 | Lienhard | |
| D273,147 S | | 3/1984 | Iverson | |
| 4,820,003 A | | 4/1989 | Lloyd | |
| 4,989,426 A | | 2/1991 | Kretchman | |
| D331,100 S | | 11/1992 | Jacobsen et al. | |
| 5,257,423 A | * | 11/1993 | Jacobsen et al. | 4/630 |
| 5,261,562 A | * | 11/1993 | Prout et al. | 220/771 |
| 5,294,012 A | | 3/1994 | Shott et al. | |
| D365,900 S | | 1/1996 | Kamm | |
| D382,058 S | | 8/1997 | Ellman et al. | |
| 6,003,706 A | | 12/1999 | Rosen | |
| 6,170,692 B1 | * | 1/2001 | Johnston | 220/475 |

* cited by examiner

*Primary Examiner*—Stephen Castellano
(74) *Attorney, Agent, or Firm*—Foley & Lardner LLP

(57) ABSTRACT

Systems and methods for providing one or more utilities are disclosed. An apparatus for providing one or more utilities includes a first module, an interface coupled to the first module, and a mounting member coupled to the interface. The mounting member is configured to receive at least two interchangeable second modules.

46 Claims, 12 Drawing Sheets

MODULAR UTILITY ASSEMBLY

CROSS REFERENCE TO RELATED PATENT APPLICATIONS

The present application claims the benefit of priority as available under 35 U.S.C. §§ 119 and 120 of the following applications: U.S. patent application No. 60/324,315 ("Modular Station Assembly System") filed Sep. 24, 2001 (incorporated by reference); U.S. patent application No. 60/330,394 ("Modular Station Assembly System") filed Oct. 18, 2001 (incorporated by reference); and U.S. patent application No. 60/351,617 ("Modular Station Assembly System") filed Jan. 24, 2002 (incorporated by reference).

FIELD

The present invention relates to modular utility assemblies such as storage and waste receptacles. The present invention further relates to modular utility assemblies having one or more functional modules or stations.

BACKGROUND

It is known to provide storage and/or waste receptacles for use in industrial, commercial and/or other applications. Such receptacles may provide utilities to a user, such as a waste container, a windshield service stations, a towel dispenser, etc. However, such systems do not readily allow one or more different utility modules to be reconfigured, or have the arrangement altered. Such receptacles do not realize certain advantageous features and/or combinations of features realized by the present invention.

It would be advantageous to provide a system that provides one or more assemblies of stations or functional modules, or combinations of modules or stations. It would further be advantageous to provide an assembly that allows for interchangeability, flexibility, reconfigurability, etc. in constructing the assembly with a variety of modules for use in service stations, near portable toilets, convenience stores, or other environments. It would further be advantageous to provide an assembly that would allow changes in configuration according to changing desires or needs by an end user. It would further be advantageous to provide an assembly including modular receptacles, sub-assemblies, sub-cabinets, and other associated modules, such as trash bags, paper towel hoppers, windshield washing service units, towel dispensers, planters, or the like. It would further be advantageous to provide an assembly including a modular aspect, such that various sub-cabinets may be coupled to a support panel or frame that includes a mounting plate to form a receptacle system such as a cabinet or service stand. It would further be advantageous to provide an assembly including a mounting plate or mounting structure for the attachment of various dispensers, racks or the like produced by different manufacturers and having varying designs and/or mounting points or configurations. It would further be advantageous to provide an assembly that includes a mounting plate coupled to or integrated into an elevated portion of a support panel or frame so that attached dispensers, racks or the like, and/or signage or printed materials, may be placed near the eye-level of a standing individual.

It would be desirable to provide a utility assembly or the like of a type disclosed in the present application that includes any one or more of these or other advantageous features.

SUMMARY

The present invention relates to an apparatus including a first module, an interface coupled to the first module, and a mounting member coupled to the interface. The mounting member is configured to receive at least two interchangeable second modules.

The present invention further relates to a utility station. The utility station includes a storage member, and an interface coupled to the storage member. The interface is configured to receive a plurality of modules having different mounting configurations. The utility station further includes a module coupled to the interface.

The present invention further relates to a modular assembly. The modular assembly comprises a first module. The first module comprises a first receptacle and a second receptacle, the first receptacle configured to hold waste, the second receptacle configured to hold fluid. The modular assembly comprises an interface coupled to the first module. The interface comprises a mounting plate adapted for interchangeability among a plurality of modules. The assembly also comprises a towel dispenser.

The present invention further relates to a service center. The service center comprises a receptacle, a windshield service station coupled to the receptacle comprising a bucket, a cover pivotally coupled to the receptacle, and an aperture provided in the cover allowing access to the receptacle.

The present invention further relates to a service center. The service center comprises a receptacle, a frame coupled to the receptacle, a panel couple to the frame, a dispenser coupled to the panel, and at least two sets of mounting points provided on the panel for coupling the dispenser to the panel.

The present invention further relates to an assembly for providing one or more utilities at a location. The assembly comprises a first utility module, a frame provided on a side of the first utility module, an interface provided on the frame, and a second utility module coupled to the interface; wherein the interface is configured to receive at least two second utility modules having different mounting configurations.

The present invention further relates to an assembly comprising a first utility module, a second utility module provided above the first utility module, and a frame provided between the first utility module and the second utility module providing for adjustable spacing between the first utility module and the second utility module.

DETAILED DESCRIPTION

Figure 1:
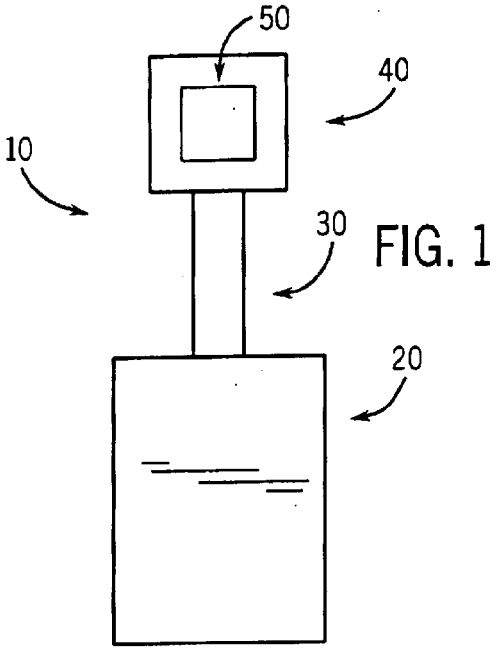
FIG. 1 is a schematic view of a modular utility assembly according to an exemplary embodiment.

As shown in the FIGURES, various exemplary embodiments of the present invention provide an assembly allowing the reconfiguration, rearrangement, modularity, and flexibility in constructing arranging, and reconfiguring various functional utility modules. The assembly provides flexibility in constructing and assembling, for example, a service station or service island. The modularity of the assembly allows for the repair, reconstruction, and adaptation of the modules before or after the initial installation. The assembly further allows for the construction of stations with a variety of structural and functional configurations and combinations. Modules and stations are interchangeable for reasons such as form, function, appearance, size, etc.

A variety of first modules or utility stations (e.g., a waste container, trash receptacle, bin, storage cabinet, container, windshield service stations, housing, etc.) may be selected for use in the assembly. The selection may be made according to desires, preferences, or other functional concerns. For example, in a gas or service station, a waste receptacle may be useful, and desired as the first, lower module. An interface (e.g., a riser, extension, frame or member(s), coacting elements, fasteners, etc.) may then be coupled to the first module. The interface may include a surface (e.g., a mounting member, mounting plate, universal mounting plate, etc.) or other configurations for attaching a variety of selected second modules. The FIGURES illustrate that a variety of second modules or stations (e.g., an upper module, portion, station or cabinet, or a side module, portion having a variety of different sizes and mounting configurations such as differently spaced mounting points, differently spaced apertures, differently spaced hooks, differently spaced brackets, etc.) may be selected for use in the assembly. This selection may be made according to desires, preferences or other functional concerns. Furthermore, if there is a change in need or desire for the assembly, the various modules may be replaced or reconfigured relatively easily with other selected modules.

Various configurations of assemblies may be used in commercial, residential, or industrial facilities, including gas stations, service stations, garages, warehouses, public areas, parks, near rest-room facilities, etc. Furthermore, the assemblies may be adapted for indoor or outdoor use.

Referring to the FIGURES, exemplary embodiments of a modular assembly are shown. The modular assembly provides one or more assemblies, stations, functional modules, or utility modules, or combinations of modules or stations. The modular assembly allows for changing the configuration according to changing desires, needs or functional concerns.

As shown in the FIGURES, exemplary embodiments of the modular assembly provide assemblies including modular receptacles, subassemblies, sub-cabinets, and other associated modules, such as trash bags, paper towel hoppers, windshield washing service units, towel dispensers, planter or the like.

Referring to FIG. 1, an exemplary embodiment of the modular assembly 10 comprises a first module 20, an interface 30, a mounting member (shown as surface 40) and a second module 50. Interface 30 is coupled to first module 20. Surface 40 is provided on interface 30. Second module 50 is coupled to surface 40.

As shown in the FIGURES, first module 20 may be provided as a lower module, lower portion, lower station, or as a base for the assembly. The first module may be a variety of different functional modules, structures, and/or stations.

Figure 21A:
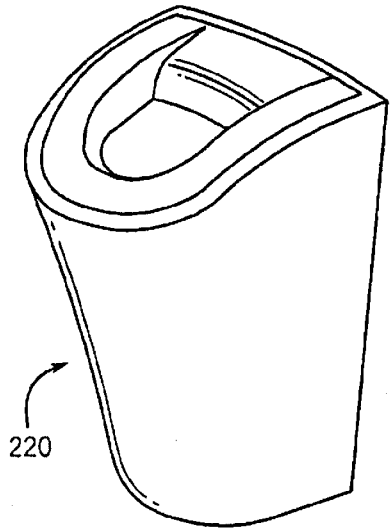
FIGS. 21A and 21B are perspective views of a module for use with a modular utility assembly according to an exemplary embodiment.
Figure 21B:
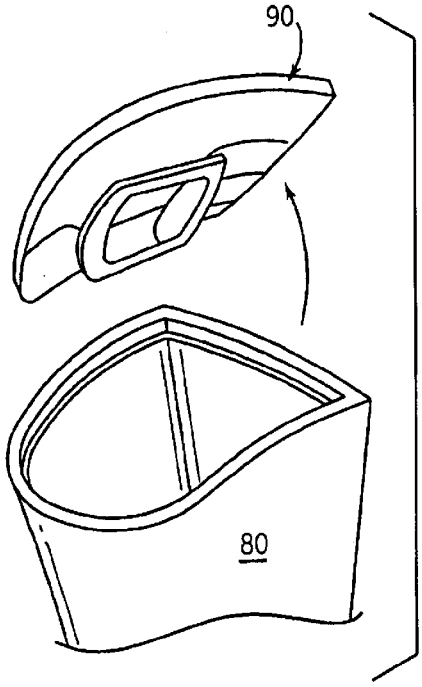

The first module may include a waste container, trash receptacle, bin, storage cabinet, container, housing, etc. as shown in FIGS. 2A to 6, 16, 17A, 17B and 19. As shown in FIGS. 21A and 21B, first module 220 (shown as a waste container) may be a single unitary body. According to an alternative embodiment as shown in FIGS. 21A and 21B, the first module may have a base 80 and a lid 90 that is removable. A removable lid 90 facilitates the removal of the waste contained in the base 80.

First module 20 may include a service center (such as a windshield service center, oil service center, maintenance service center, etc.). A windshield service center may include a support structure or framework for supporting and receiving receptacles, containers, or buckets (see FIGS. 2A, 2B and 4A to 12). These receptacles may be for holding fluid such as water or windshield washing fluid. The windshield service center may further include a towel dispenser (see FIG. 5).

Figures 2A, 2B, 4A, 4B:
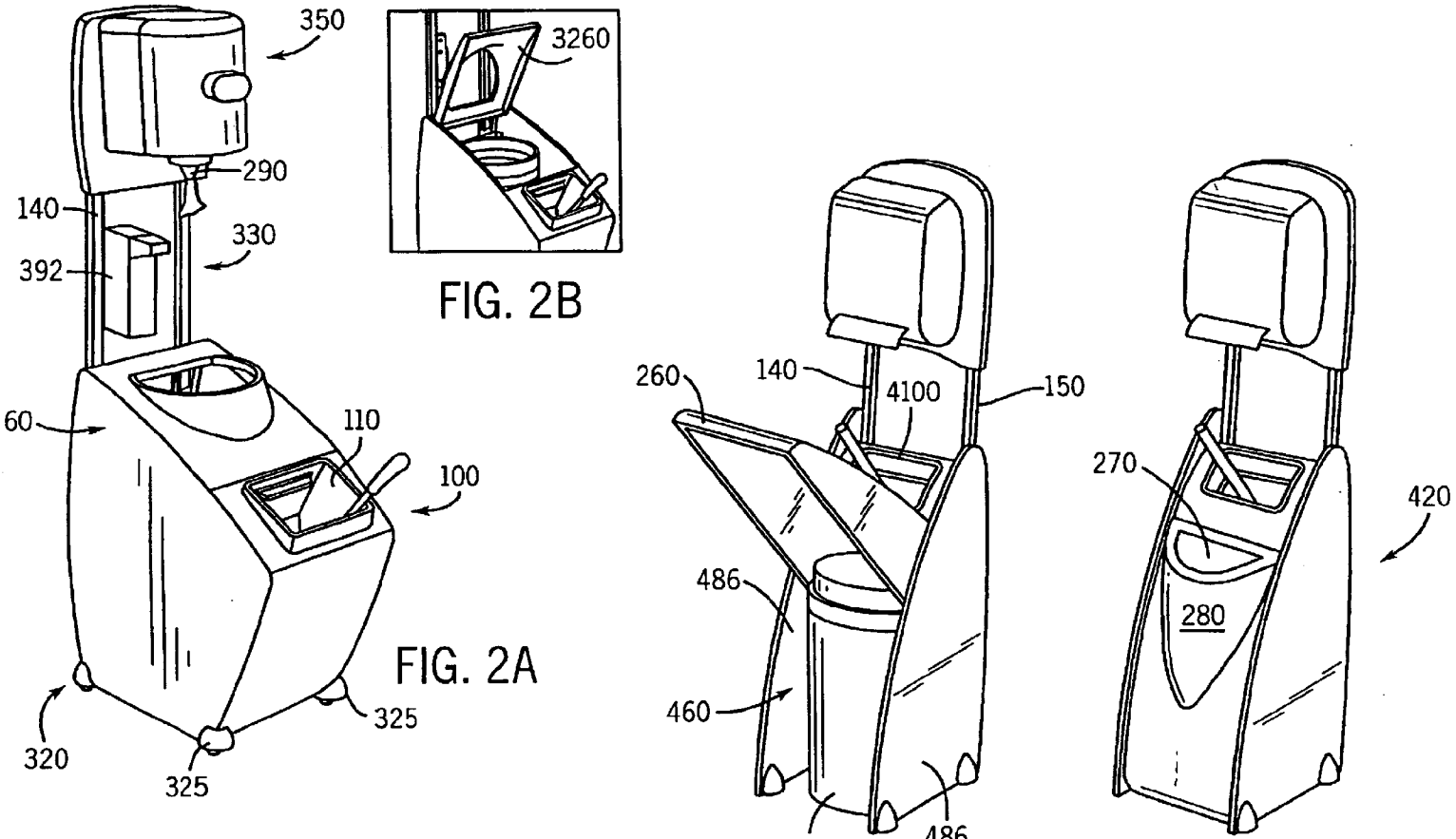
FIG. 2A is a perspective view of a modular utility assembly according to an exemplary embodiment.
FIG. 2B is a partial view of the modular utility assembly of FIG. 2A in greater detail.
FIG. 4A is a perspective view of a modular utility assembly according to an exemplary embodiment.
FIG. 4B is a perspective view of the modular utility assembly of FIG. 4A according to an exemplary embodiment.

According to an exemplary embodiment as shown in FIG. 2 FIGS. 2A and 2B, a windshield service center 100 may include a single bucket 110. According to an alternative embodiment shown in FIG. 14, windshield service center 5100 may include dual buckets 5110, 5120. According to other alternative embodiments, any number, combinations, and configurations of buckets may be used.

According to an exemplary embodiment as shown in FIGS. 2A and 2B, first module 320 may also be a combination of waste container 60 and windshield service center 100. In an exemplary embodiment shown in FIG. 5, a windshield service center 6100 is provided on a side of the waste container 660. Windshield service center 6100 has a bucket 6110 for holding fluid and a towel dispenser 6120.

Figure 8:
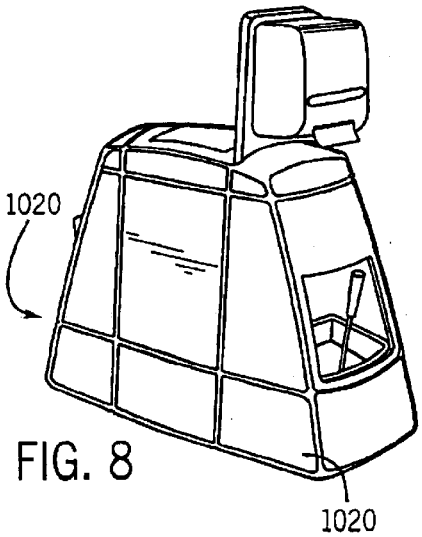
FIG. 8 is a perspective view of a modular utility assembly according to an exemplary embodiment.
Figure 9:
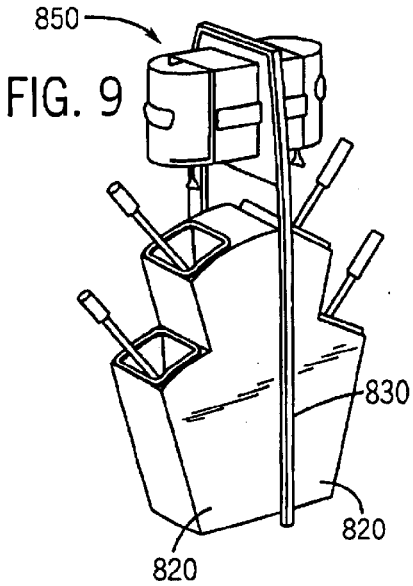
FIG. 9 is a perspective view of a modular utility assembly according to an exemplary embodiment.
Figure 10:
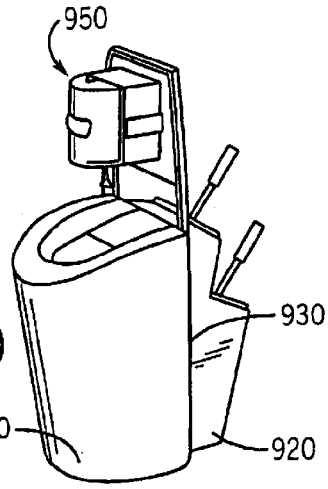
FIG. 10 is a perspective view of a modular utility assembly according to an exemplary embodiment.

According to an embodiment as shown in FIGS. 8 to 10, first modules 820, 920, 1020 may be provided as one or more side modules, side portions, or as a side-by-side members for the assembly. The side module may be a variety of different functional modules such as receptacles, service centers, etc.

Figure 16A:
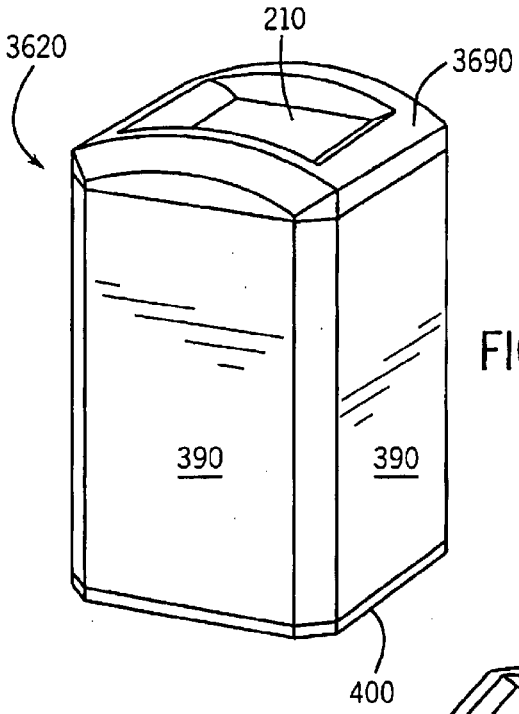
FIG. 16A is a perspective views of a module for use with a modular utility assembly according to an exemplary embodiment.
Figure 16B:
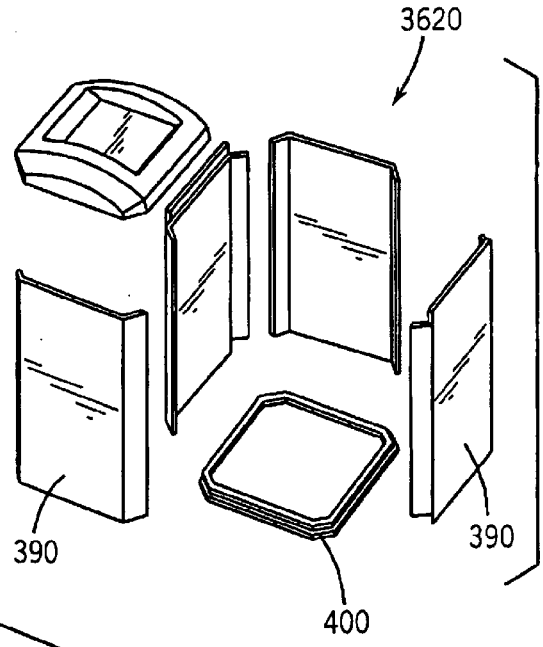
FIG. 16B is an exploded perspective view of the module of FIG. 16A according to an exemplary embodiment.
Figure 16C:
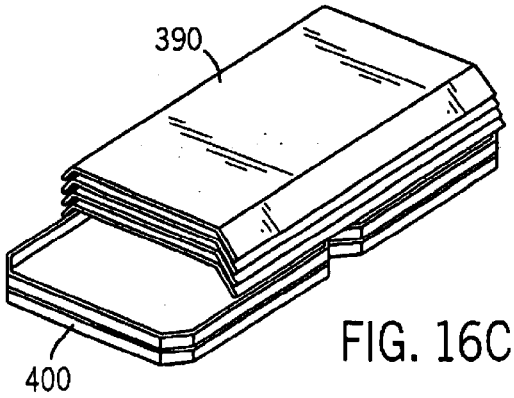
FIG. 16C is a perspective view of the module of FIGS. 16A and 16B according to an exemplary embodiment.

In an exemplary embodiment as shown in FIGS. 16A through 16C, first module 3620 may comprise a multiple piece waste container assembled from a plurality of panels 390, a base 400 and lid 3690 with opening 210 that may be shipped in a disassembled state, and assembled on-site using a variety of fasteners or other interconnection means (e.g., screws, nuts/bolts, corner pieces, tongue-in-grove connections, locking clips and the like).

Figure 3:
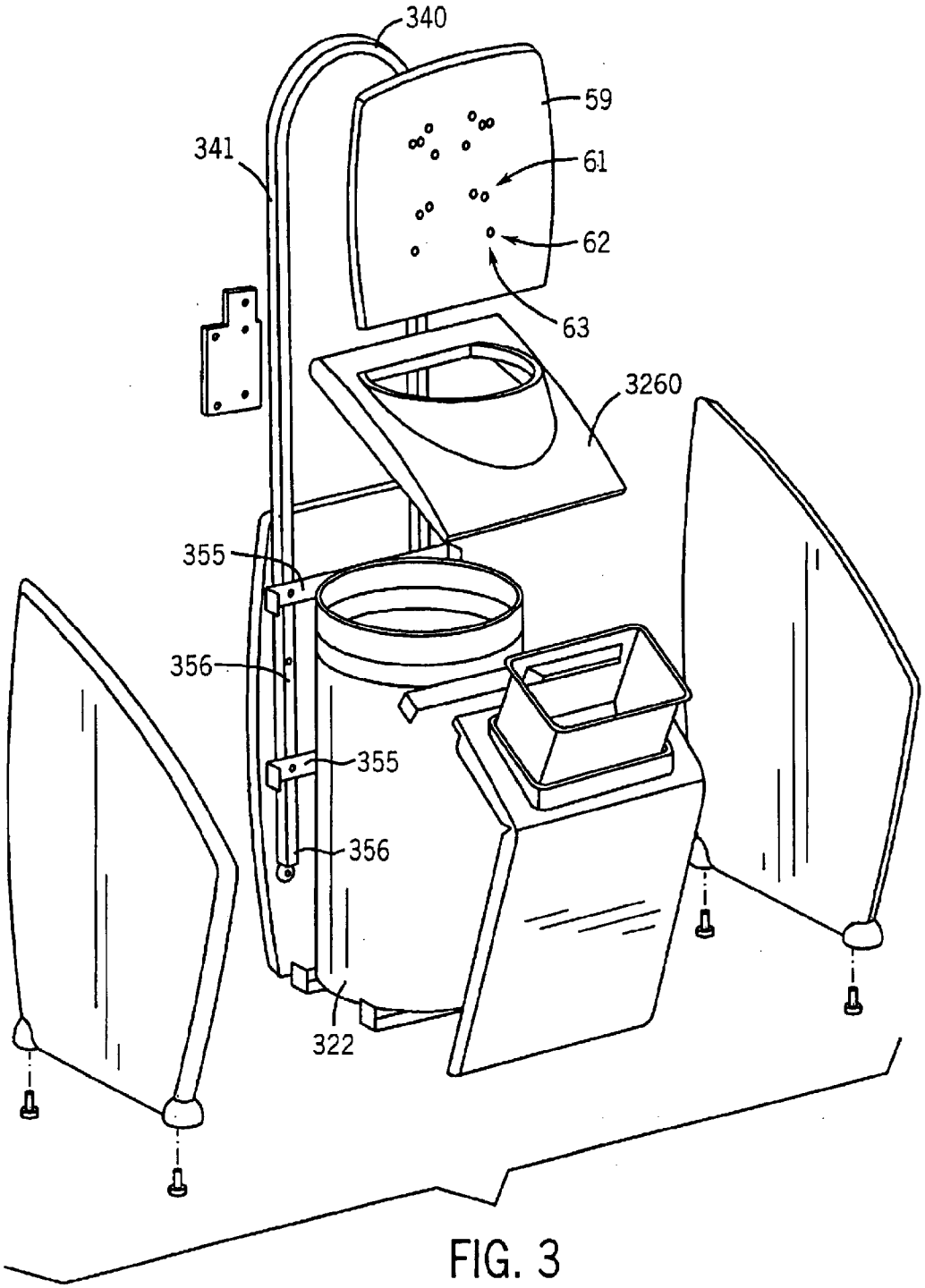
FIG. 3 is an exploded perspective view of a modular utility assembly according to an exemplary embodiment.
Figure 5:
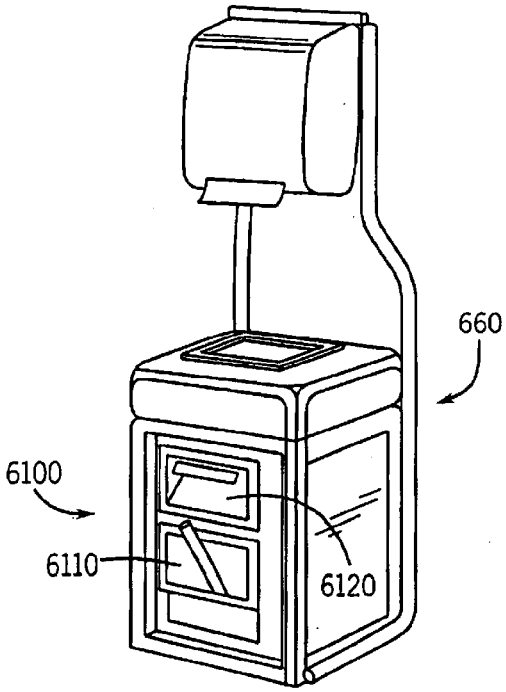
FIG. 5 is a perspective view of a modular utility assembly according to an exemplary embodiment.

In an exemplary embodiment shown in FIG. 3, a rigid liner 322, such as a bucket or an open-faced box, may be housed in first module 320 as a waste receptacle. Alternatively, a flexible liner such as a trash bag may be housed in the module as a waste receptacle. The flexible liner may be secured within the waste container by retention clips, by an inwardly directed flange that is laterally flared or notched along an outer face in combination with an elastic retention band or by a set of hinged retainer rings.

Figure 17A:
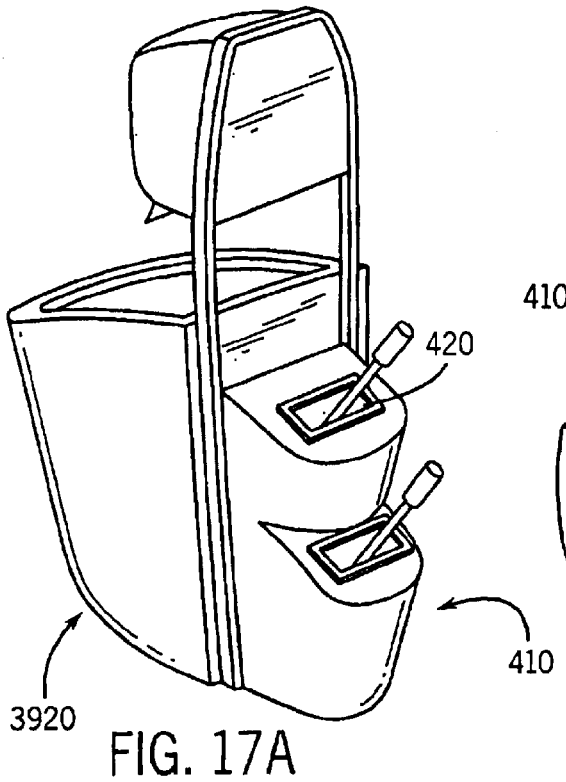
FIGS. 17A and 17B are perspective views of a modular utility assembly according to an exemplary embodiment.
Figure 17B:
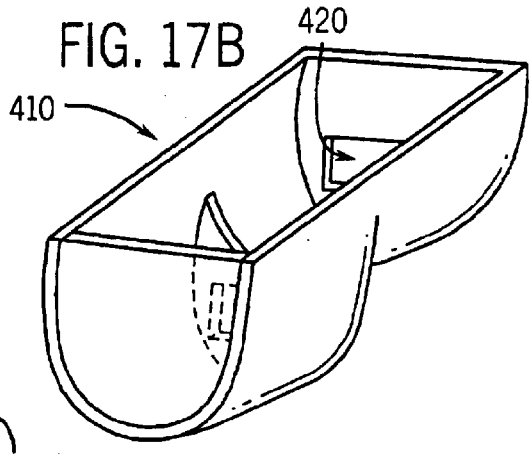
Figure 18:
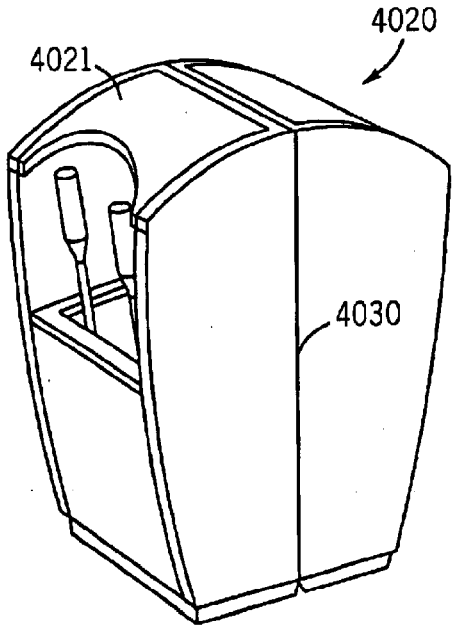
FIG. 18 is a perspective view of a modular utility assembly according to an exemplary embodiment.

In an exemplary embodiment as shown in FIGS. 17A and 17B, first module 3920 may comprise a single piece chassis 410 including one or more openings 420. The rear portion of chassis 410 may be omitted if chassis 410 will consistently be coupled to support panels or other sub-cabinets with similar or larger profiles. Windshield washing service units or similar bin-like receptacles may be supported within the chassis by an exterior flange that overlaps a perimeter edge of the chassis opening. In another exemplary embodiment as shown in FIG. 18, first module 4020 may comprise a container-like chassis that includes a partial side opening and a cover portion 4021, as shown in FIG. 18. Windshield washing service units or similar bin-like receptacles that are inserted into the chassis may rest on a the bottom of the chassis or be supported by a combination of simple engagement with an inner surface of the chassis and a flange portion that overlaps a lower edge of the container side opening. A flange may still be provided in either case to ease removal of the receptacle from the container.

Figure 19:
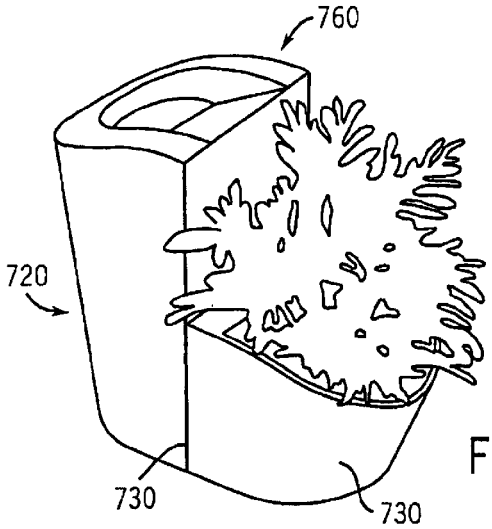
FIG. 19 is a perspective view of a modular utility assembly according to an exemplary embodiment.

According to an exemplary embodiment as shown in FIG. 19, first module 720 may comprise waste container 760 and a planter 730. Soil may be placed in planter 730 for growing plants, shrubs, bushes, flowers, etc o improve the aesthetics surrounding the assembly.

According to various exemplary embodiments, the first module may be constructed from polymer concrete, polyethylene, cast aluminum, steel, various metal and steel alloys, plastics, and other polymers. In an exemplary embodiment, the first module is constructed from a polymer concrete commercially available from Forte Composites, Inc. of Green Bay, Wis.

According to an exemplary embodiment as shown in FIG. 1, an interface 30 may be provided between first module 20 and second module 50.

Figure 6:
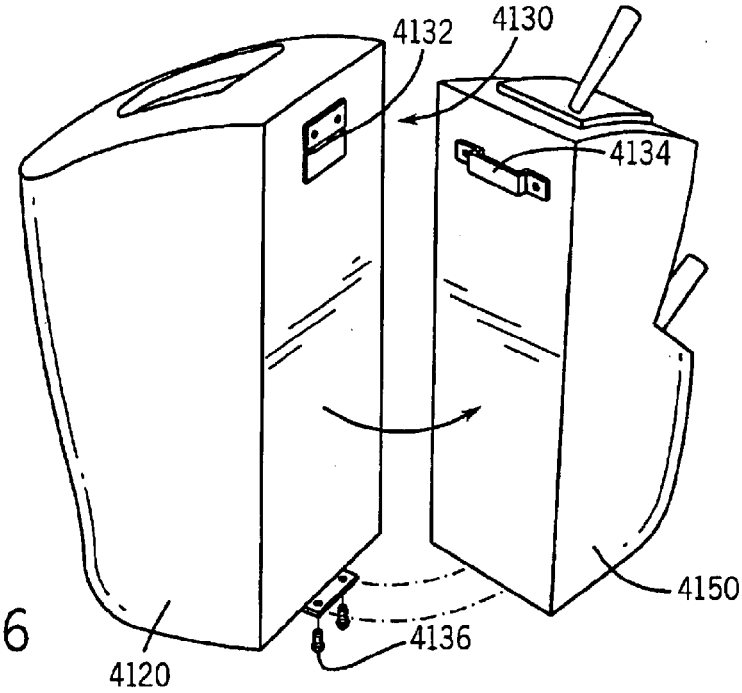
FIG. 6 is an exploded perspective view of a modular utility assembly according to an exemplary embodiment.
Figure 7:
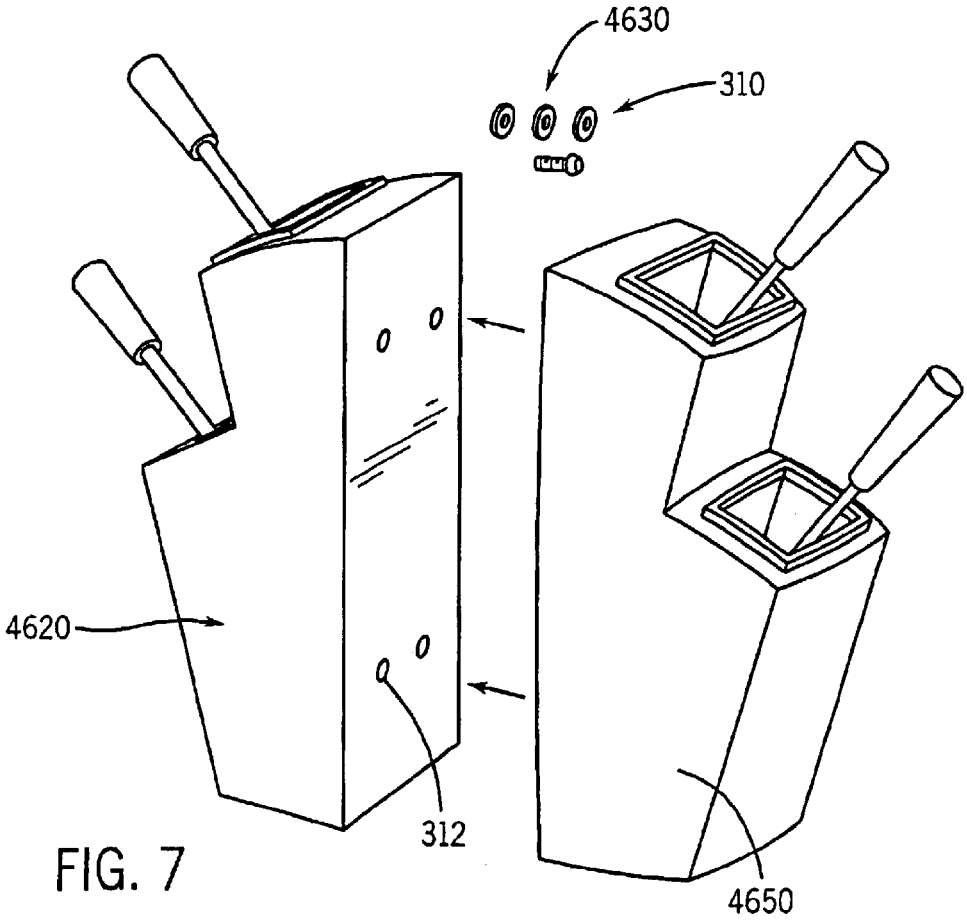
FIG. 7 is an exploded perspective view of a modular utility assembly according to an exemplary embodiment.

The interface provided between the first module and second module may be a riser, extension, frame, or member shown as a rectangular tube frame 341 in FIG. 3. According to an alternative embodiment, the interface may be fasteners, clips, etc. as shown in FIGS. 6 and 7.

According to an exemplary embodiment, the interface may be configured to have an adjustable height. For example, the interface may be provided with multiple mounting points at multiple heights at which it may be coupled to the first and/or second module. Alternatively, the interface may be configured similar to an extension pole having a number of preset heights which may be adjusted by depressing a locking element from engagement in one aperture, adjusting the height of the interface, and releasing the locking element to engage in another aperture at a different height. It should be noted that a variety of different adjustment positions, at a variety of intervals, and any number of adjustment positions may be provided with the system.

Figure 14:
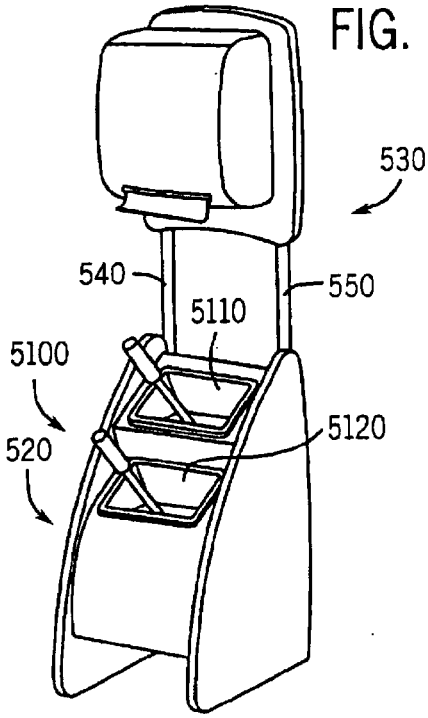
FIG. 14 is a perspective view of a modular utility assembly according to an exemplary embodiment.

According to an exemplary embodiment as shown in FIG. 14, interface 530 may comprise two vertically extending members 540 and 550 extending away from the first module 520. Interface 530 may be fastened to first module 520 using a variety of fasteners including screws, bolts, fasteners that are co-molded or molded into the body of module 520, etc. According to an alternative embodiment, the interface may be molded into the body of first module during the construction of the first module.

Figure 15:
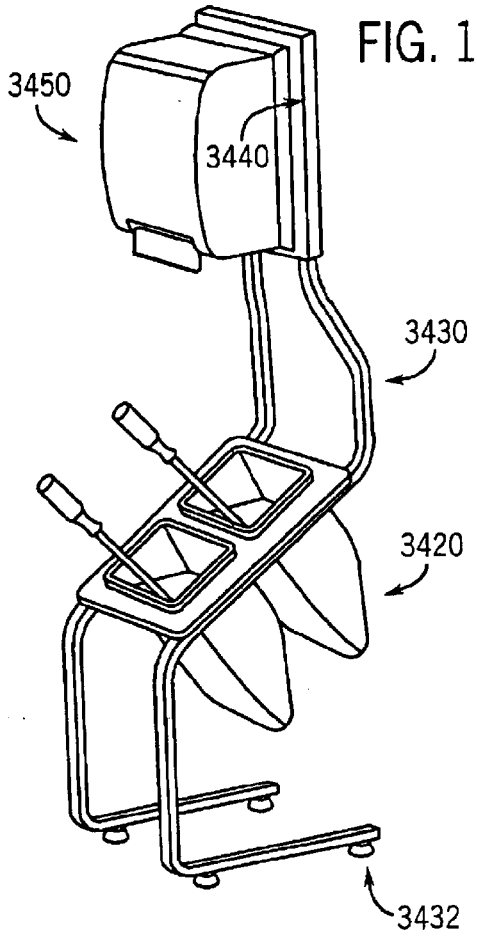
FIG. 15 is a perspective view of a modular utility assembly according to an exemplary embodiment.

In an exemplary embodiment shown in the FIG. 15, interface 3430 may be a frame work or an open frame work arrangement which in part serves as a base, having supports such as feet 3432. First module 3420 is received in interface 3430, and an second module 3450 may be received or coupled to surface 3440. Modules may be selectively attached to and removed from the framework (by bolting, etc.).

According to a particularly preferred embodiment, the interface is constructed from steel tubing. Alternatively, the interface may be constructed from stainless steel, aluminized steel alloy, aluminum alloy, polymers, composites, fiberglass, plastics, mechanical fasteners, etc.

The interface provided between the first module and second module may be an interface or frame provided between the modules. In an exemplary embodiment as shown in FIGS. 9 and 10, the interface 830 or 930 is provided between modules 820 or 920 and 850 or 950 to provide a member to which both modules may be attached/fastened/coupled, etc. In an exemplary embodiment as shown in FIG. 7, first module 4620 and second module 4650 are coupled with an interface 4630 comprising fasteners such as bolts 310 and one or more mounting points shown as apertures 312. In alternative embodiments, the first and second modules are placed "back to back" with each other. The first and second modules may or may not be attached to each other. The first and second modules may be simply proximate one another. In an alternative embodiment as shown in FIG. 6, a latch or hook assembly 4130 (comprising member 4132 which coacts with member 4134 and fasteners 4136 which coact with fasteners provided on module 450) or other selectively attachable mechanism may be provided between the first and second modules and/or provided on a frame. Alternatively, pins or bolts may be provided between the first and second modules to connect the two modules.

Figure 20:
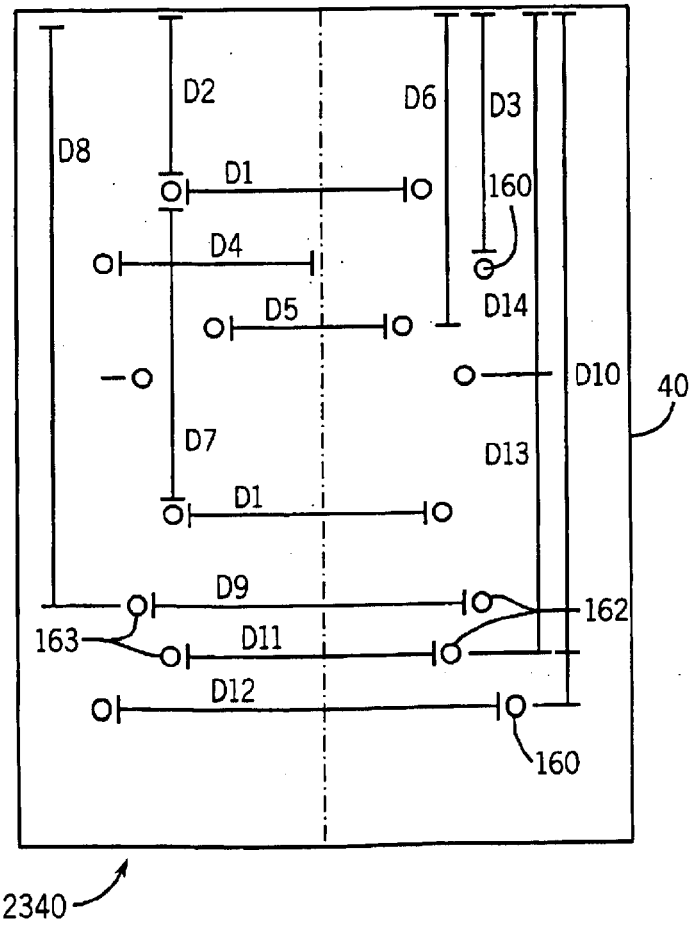
FIG. 20 is a top plan view of an interface for use with a modular utility assembly according to an exemplary embodiment.

According to an exemplary embodiment as shown in FIG. 1, a mounting member 40 may be provided on or coupled to interface 30. Mounting member 40 may be a mounting plate, a mounting surface, or a support surface (e.g., interface). Mounting member or interface 59 comprising fasteners 62, inserts 61 (e.g., fastener inserts, molded-in inserts, fasteners, etc.), mounting or attachment points 63 is provided as shown in FIG. 3. According to a particularly preferred embodiment as shown in FIG. 20, mounting member 2340 is configured such that it provides a "universal" interface or mounting surface for selected second modules. For example, mounting member or interface 2340 is configured to receive two or more differently sized second modules (e.g., modules of different size and/or having different mounting or attachment points or mounting configurations). In a particularly preferred embodiment as shown in FIG. 20, mounting member or interface 2340 includes pre-positioned molded-in inserts 160 (e.g., fastener inserts or fasteners) and fasteners 162 to provide attachment or mounting points 163. Mounting member 2340 is configured to allow for interchangeability between or support of or providing mounting points for a variety of configuration of paper towel dispensers having different mounting points. Various distances (D1–D14) between pre-positioned molded-in inserts 160 are shown in FIG. 20. In the particularly preferred embodiment, D1 is 3.50 inches, D2 is 2.75 inches, D3 is 3.50 inches, D4 is 3.00 inches, D5 is 2.50 inches, D6 is 4.50 inches, D7 is 5.00 inches, D8 is 9.4375 inches D9 is 5.25 inches, D10 is 10.50 inches, D11 is 5.00 inches, D12 is 6.00 inches, D13 is 5.00 inches, and D14 is 5.125 inches. According to various alternative embodiments, a variety of dimensions and/or spacings may be used that provide mounting points for one or two or more modules. A variety of paper towel models may be mounted to mounting member 2340. This allows for the paper towel dispensers to be changed according to preferences or desires without requiring reconstruction of the unit, re-drilling of holes, etc. Paper towel dispensers may be quickly and easily changed due to the interchangeability and "universal" design of the mounting member. According to an alternative embodiment, the mounting member or plate or surface may be configured to allow the selective interchangeability of any of a variety of selected second modules. According to an alternative embodiment, the mounting member or plate or surface may provide one or more adjustable brackets, frames, etc. for mounting second modules.

In an exemplary embodiment, the surface on the interface may be constructed from polymer concrete, polymers, plastics, etc. According to other alternative embodiments, a variety of materials may be used including metals, alloys, composites, etc.

The second module may be a variety of different functional modules, structures, utility assemblies, and/or stations.

Figure 11A:
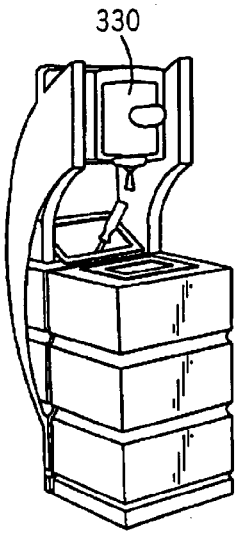
FIGS. 11A through 11C are perspective views of a modular utility assembly according to various exemplary embodiments.
Figure 11B:
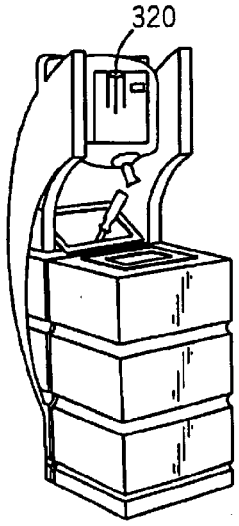
Figure 11C:
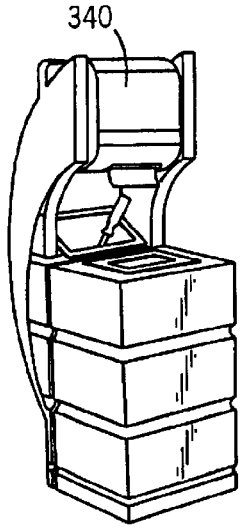
Figure 12:
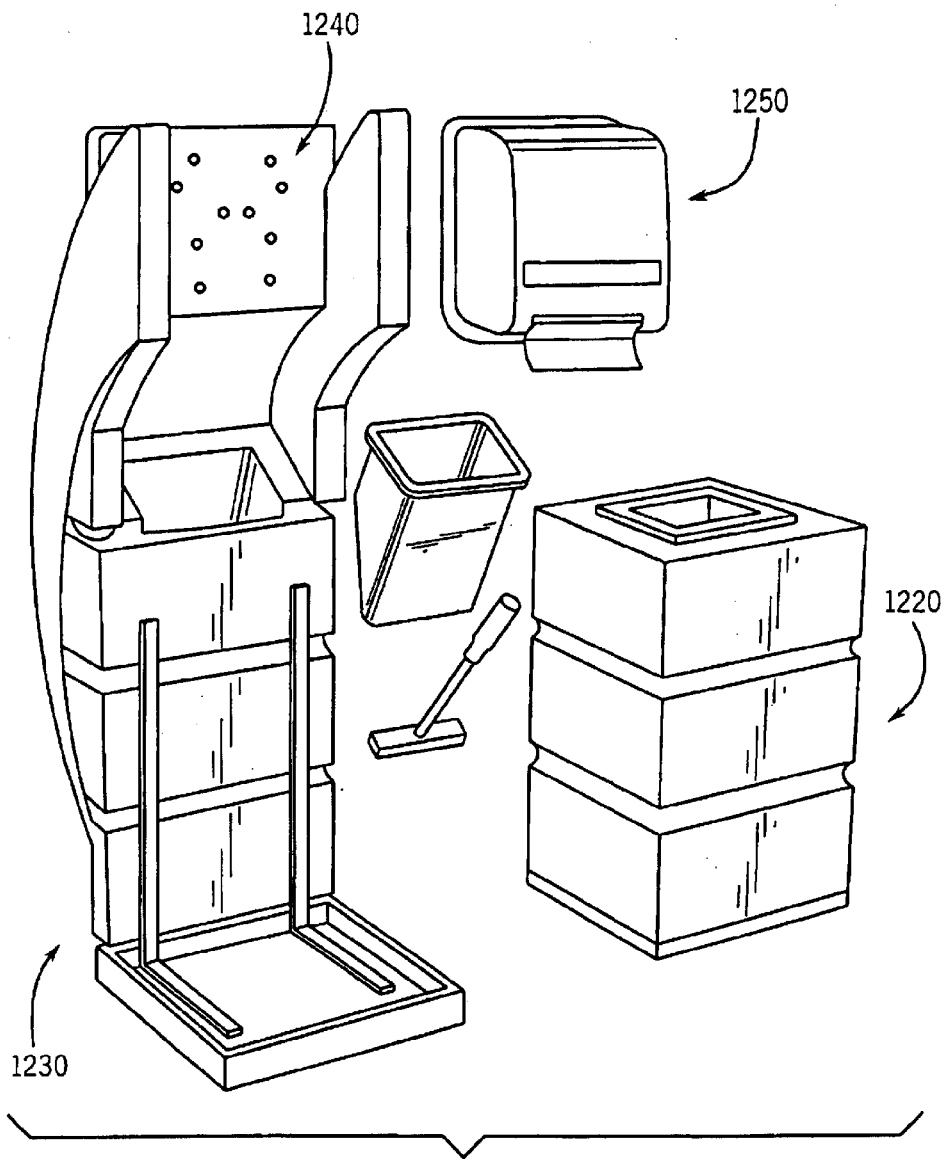
FIG. 12 is an exploded perspective view of a modular utility assembly according to an exemplary embodiment.

As shown in FIGS. 2A and 2B, second module 350 may be a utility station such as a paper towel dispenser 290. In exemplary embodiments as shown in FIGS. 11A through 11C, a center-pull towel dispenser 320, a roll towel dispenser 330, or a folded towel dispenser 340 may be mounted to the mounting member. Various configurations and types of paper towel dispensers may be mounted to the mounting member or to the interface.

According to an exemplary embodiment, the second module may be provided as an upper module, portion, station or cabinet or as a side module, portion, station or cabinet for the assembly. The second module may comprise a variety of different functional modules such as a soap dispenser, sanitizer dispenser, hand cleaner, waterless hand cleaner dispensers, etc. In an exemplary embodiment, the second module and/or interface may include, be configured to receive and/or allow removal of, in addition to other functional modules, a soap dispenser, sanitizer dispenser, hand cleaner, waterless hand cleaner dispensers, etc available from Zep Manufacturing Company of Atlanta Ga.

According to alternative embodiments, the second module may include, be configured to receive and/or allow removal of, in addition to other functional modules, a paper towel dispenser commercially available from von Drehle Corporation of Hickory, North Carolina, from Georgia Pacific of Augusta Ga., or from SCA (formerly known as Tork, or Molyencke) of Sweden.

Figure 13:
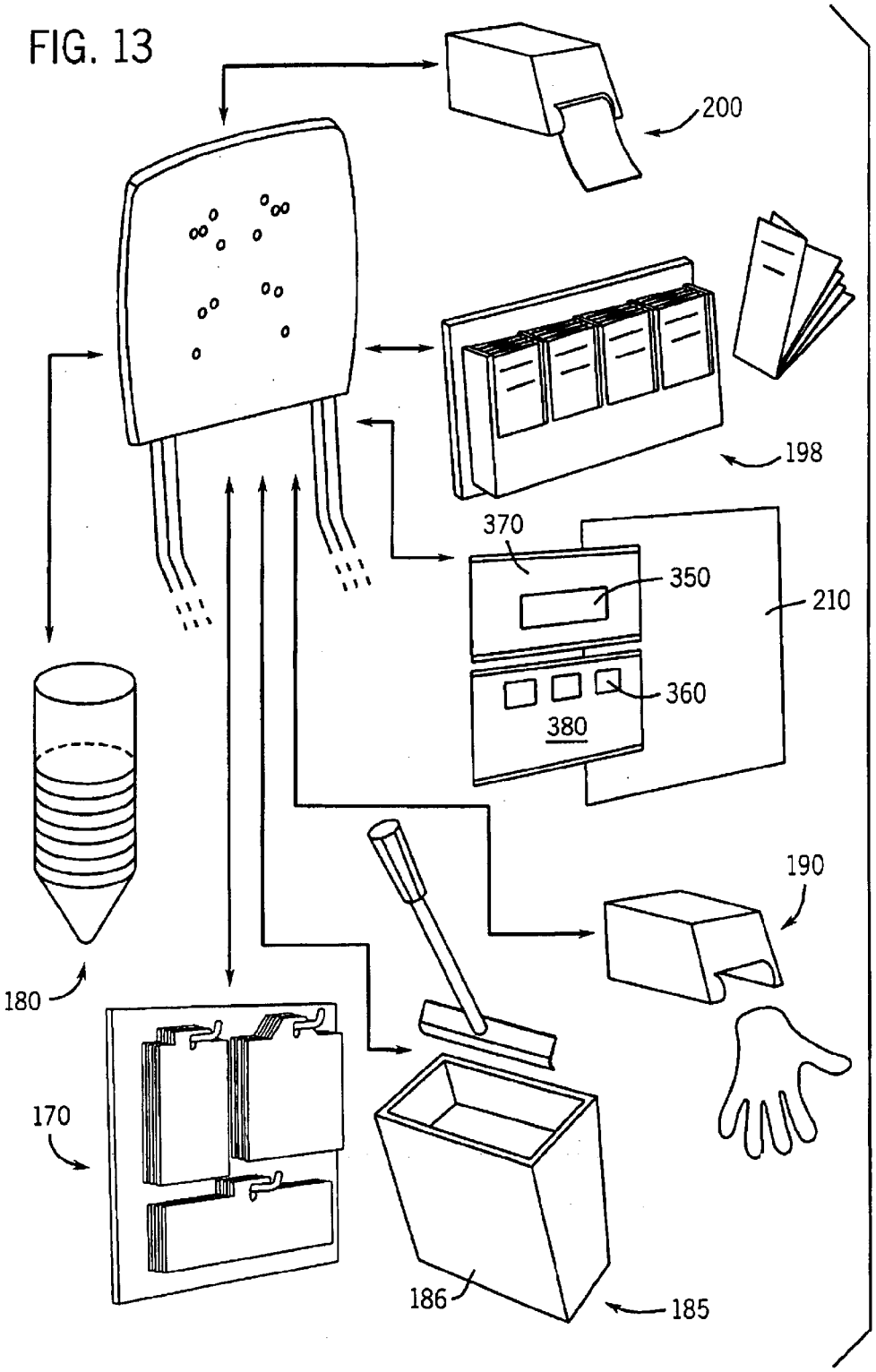
FIG. 13 is an exploded perspective view of a module and interface for use with a modular utility assembly according to an exemplary embodiment.

As shown in FIG. 13, the second module may be any number and variety of modules, utilities, or assemblies.

The second module may be merchandising units such as displays, cabinets, storage units, etc. for holding, storing and displaying goods and merchandise. The merchandising units may include shelves, wire racks, display hooks, clips, etc. for use in displaying merchandise. As shown in FIG. 13, the second module may be or include a product merchandiser 170. Product merchandiser 170 may be used for displaying good, products, merchandise etc.

The second module may be or include an oil service center 180. As shown in FIG. 13, the oil service center 180 may include a dispenser for oil funnels, paper towels, etc.

The second module may be or include a windshield service center 185. Windshield service center 185 may include a container or bucket 186 for holding windshield washing fluid, squeegees, etc. Windshield service center 185 may further include a paper towel dispenser (not shown).

The second module may be or include a glove dispenser 190 for use in car maintenance.

The second module may be or include a dispenser (shown as dispensers 198 and 200. The dispenser may be used to distribute promotional materials, including coupons, flyers, brochures, etc.

The second module may be or include a display or display surface 210 for information graphics or advertising. The second module may be a frame 370, surface 380, etc. for receiving graphics 350 or advertising 360. In an exemplary embodiment, the graphics or advertising material may be removable, interchangeable, or temporarily affixed to the upper module. In an exemplary embodiment, the graphics or advertising materials may be permanently attached the upper module.

In alternative embodiments, the various modules described above may be provided in a variety of different combinations and orientations. For example, the modules may be provided next to each other, in a side-by-side configuration as shown in the FIGURES, as well as being provided in a variety of other vertical and horizontal combinations, including modules on top of each other, etc. The assembly may be formed or assembled from one or two or more modules or stations in various arrangements and configurations.

In an exemplary embodiment, the modular assembly 10 includes two or more sub-structures that may be assembled or constructed to form a service stand, service center or assembly. These substructures may be sub-cabinets. The sub-structure may receive one or more receptacles within a substantially closed structure such as sub-frames. The sub-structure may also receive one or more receptacles within a substantially open structure, or as support panels or frames that include an elevated mounting plate.

An exemplary embodiment of a modular utility assembly according to the present invention is shown in FIGS. 4A and 4B. First module 420 includes waste receptacle portion 460 and windshield service station 4100. Waste receptacle portion 460 includes liner 240 (such as a waste can, bin, receptacle, bucket, trash bag liner and/or trash bag frame, etc.) and a cover portion 260. Liner 240 is received in a space between two panels 486 that are attached to an interface or frame work. Cover 260 is hinged to first module 420. This configuration allows cover 260 to be moved out of the way, allowing access to liner 240 for emptying, etc. without disassembling the system. As shown in FIGS. 4A and 4B, cover 260 is hinged along an upper edge. According to an alternative embodiment, the cover may be hinged along either side edge, or a bottom edge, which would allow for the selective access to the liner. According to an alternative embodiment, the cover may be completely removable from the lower module, i.e. it may clip on, be fastened on with a variety of fasteners, screws, bolts, etc. In an exemplary embodiment, cover 260 may include an aperture or opening 270 such that waste may be inserted through cover 260, and be received in liner 240. According to a particularly preferred embodiment, cover 260 may include a bulge or protrusion 280 which accommodates the space required for liner 240. According to this particularly preferred embodiment, aperture 270 is provided in a portion of this bulge 280.

According to another exemplary embodiment shown in FIGS. 2A, 2B and 3, the placement orientation, and configuration of one or more stations within a module may be altered. As shown, the waste receptacle portion 60 is provided toward the back of the assembly, and windshield service station 100 is provided toward the front of the assembly. Waste receptacle portion 60 may be provided with lid 3260 which is moveable, allowing easier access to the waste receptacle portion. In other alternative embodiments, the lid may be provided on the back side of the system, may hinge from the front, or side, may be completely removable, etc. First module 320 may be provided with feet 325 (e.g., levelers, casters, rollers, etc.) to allow easier movement, placement or leveling of the assembly. As shown in FIG. 2A, a first sized hand towel dispenser 290 is shown attached as part of second module 350. According to a particularly preferred embodiment, the assembly allows for 6 inches of vertical adjustment for hand towel dispenser 290. Alternatively, a wide range of adjustment positions may be used.

A dispenser 392 (e.g., sanitizer dispenser, soap dispenser, towel dispenser, sanitary wipe dispenser, etc) may be coupled to interface 30.

According to the particularly preferred embodiment shown in FIGS. 2A, 2B and 3, the height of second module 350 relative to first module 320 may be adjusted. Interface 340 (including members 140 and 150) is provided with two or more sets of apertures (or bolting positions shown as points 355 and 356) to provide interface 340 and second module 350 at different heights relative to first module 320 (see FIG. 2A). According to various alternative embodiments, any number of adjustment positions may be provided to adjust the height of the interface (and second module) relative to the first module. According to an alternative embodiment, the interface or frame may be provided with a variety of adjustment positions.

It is also important to note that the construction and arrangement of the elements of the system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability, in any of a wide variety of colors, textures and combinations. It should also be noted that the system may be used in association with adjustable, or fixed and non-movable systems or any of a wide variety of other modules in any of a wide variety of other applications. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. An apparatus configured for use with a plurality of interchangeable modules comprising:

a base comprising a first receptacle and a second receptacle;

a frame coupled to the base;

a plate coupled to the frame and configured for the attachment of at least one interchangeable module; and a first module coupled to the plate;

wherein the frame can be coupled to the base in a first configuration to provide the first module at a first position and coupled to the base in a second configuration to provide the first module at a second position; and wherein the first position comprises a first height and the second position comprises a second height.

2. The apparatus of claim 1 wherein the first receptacle is configured to hold waste material.

3. The apparatus of claim 1 wherein the second height is greater than the first height.

4. The apparatus of claim 1 wherein the frame comprises a tube frame.

5. The apparatus of claim 1 wherein the second height is directly vertical to the first height.

6. The apparatus of claim 1 further comprising a second module coupled to the frame.

7. The apparatus of claim 6 wherein the second module comprises at least one of a sanitizer dispenser, soap dispenser, towel dispenser, and sanitary wipe dispenser.

8. The apparatus of claim 1 wherein the second receptacle comprises a windshield service station.

9. The apparatus of claim 1 further comprising a cover pivotally coupled to the base.

10. The apparatus of claim 1 wherein the plate comprises a plurality of mounting locations for mounting the interchangeable modules relative to the plate.

11. The apparatus of claim 1 wherein the first module comprises a towel dispenser.

12. The apparatus of claim 1 wherein the base comprises a plurality of segments.

13. The apparatus of claim 12 wherein the plurality of segments comprise a front, a back, and sides.

14. The apparatus of claim 1 wherein the frame is configured to provide adjustment between the base and the plate.

15. The apparatus of claim 1 wherein the base is configured to provide adjustment between the base and the plate.

16. The apparatus of claim 1 wherein the first receptacle comprises a compartment in which a rigid container is placed.

17. The apparatus of claim 16 wherein the rigid container comprises a bucket.

18. The apparatus of claim 1 wherein the plate comprises fasteners provided in the plate.

19. The apparatus of claim 18 wherein the fasteners provided in the plate further comprise fastener inserts molded into the plate.

20. The apparatus of claim 18 wherein the plate comprises fastener inserts provided on the plate.

21. The apparatus of claim 1 wherein the first receptacle comprises a liner.

22. The apparatus of claim 1 wherein the plate comprises a universal interface.

23. The apparatus of claim 22 wherein the interface comprises means for interchanging the plurality of modules.

24. The apparatus of claim 23 wherein the interface comprises pre-positioned attachment points.

25. The apparatus of claim 24 wherein the attachment points are molded-in inserts.

26. A service center configured for use with a plurality of interchangeable modules comprising:

a base comprising a first receptacle having a compartment and a second receptacle;

a cover pivotally coupled to the first receptacle;

an aperture provided in the cover allowing access to the receptacle;

a frame coupled to the base;

a first module coupled to the frame; and a second module coupled to the frame;

wherein the frame can be coupled to the base in a first configuration to provide the first module at a first position and coupled to the base in a second configuration to provide the first module at a second position; and wherein the first position comprises a first height and the second position comprises a second height.

27. The service center of claim 26 further comprising a first interface coupled to the frame and the first module.

28. The service center of claim 27 wherein the first interface comprises a plate adapted for interchangeable attachment of at least one of a plurality of modules.

29. The service center of claim 28 wherein the plate comprises a plurality of mounting locations for mounting the modules relative to the plate.

30. The service center of claim 26 wherein the second height is directly vertical to the first height.

31. The service center of claim 26 wherein the frame comprises a riser.

32. The service center of claim 26 further comprising a member attachable to the frame for coupling the second module to the frame.

33. The service center of claim 32 wherein the member is a plate.

34. The service center of claim 26 wherein the second module comprises one of a sanitizer dispenser, soap dispenser, towel dispenser, and sanitary wipe dispenser.

35. The service center of claim 26 wherein the second receptacle comprises a windshield service station configured to hold fluid.

36. The service center of claim 26 wherein the first receptacle comprises a rigid container placed in the compartment.

37. An assembly for providing one or more utilities at a location and configured for use with a plurality of interchangeable modules comprising:

a first module comprising a first receptacle and a second receptacle;

a frame provided near a segment of the first module;

a first interface provided on the frame;

a second module coupled to the first interface;

a second interface provided on the frame; and a third module coupled to the second interface; and wherein the first interface comprises a plurality of mounting locations for mounting interchangeable modules;

wherein the frame can be coupled to the first module in a first configuration to provide the second module at a first position and coupled to the first module in a second configuration to provide the second module at a second position; and wherein the first position comprises a first height and the second position comprises a second height.

38. The assembly of claim 37 wherein the second height is directly vertical to the first height.

39. The assembly of claim 37 wherein the first receptacle comprises a compartment in which a rigid container is placed.

40. The assembly of claim 37 further comprising panels provided on sides of the first module.

41. The assembly of claim 37 wherein the first receptacle is configured to hold waste material.

42. The assembly of claim 41 wherein the first receptacle comprises a liner.

43. The assembly of claim 37 wherein the second receptacle comprises a windshield service station.

44. The assembly of claim 37 wherein the frame comprises a riser.

45. The assembly of claim 37 wherein the third module is configured to comprise at least one of a sanitizer dispenser, soap dispenser, towel dispenser, and sanitary wipe dispenser.

46. The assembly of claim 37 wherein the second height is greater than the first height.

* * * * *